United States Patent [19]

Nyrhilä et al.

[11] Patent Number: 5,061,439

[45] Date of Patent: Oct. 29, 1991

[54] MANUFACTURE OF DIMENSIONALLY PRECISE PIECES BY SINTERING

[75] Inventors: Olli J. Nyrhilä; Seppo O. Syrjälä, both of Turku, Finland

[73] Assignee: Aktiebolaget Electrolux, Stockholm, Sweden

[21] Appl. No.: 613,582

[22] PCT Filed: Mar. 28, 1990

[86] PCT No.: PCT/SE90/00198

§ 371 Date: Nov. 29, 1990

§ 102(e) Date: Nov. 29, 1990

[87] PCT Pub. No.: WO90/11855

PCT Pub. Date: Oct. 18, 1990

[30] Foreign Application Priority Data

Apr. 7, 1989 [SE] Sweden ..... 8901235
Apr. 14, 1989 [SE] Sweden ..... 8901359

[51] Int. Cl.[5] ..... B22F 7/00

[52] U.S. Cl. ..... 419/9; 419/10; 419/23; 419/39; 419/47; 228/173.6

[58] Field of Search ..... 419/23, 39, 9, 10, 47; 228/173.6

[56] References Cited

U.S. PATENT DOCUMENTS

| | | | |
|---|---|---|---|
| 3,779,717 | 12/1973 | Gustison | 419/23 |
| 3,957,508 | 5/1976 | Davies et al. | 419/23 |
| 4,838,936 | 6/1989 | Akechi | 419/23 |
| 4,971,755 | 11/1990 | Kawano et al. | 419/23 |

*Primary Examiner*—Stephen J. Lechert, Jr.
*Attorney, Agent, or Firm*—Pearne, Gordon, McCoy & Granger

[57] ABSTRACT

The invention relates to a method for the manufacture of dimensionally precise pieces which are at least in part made of a sintered material. The material comprises a mixture of at least three pulverous constituents, of which the first is mainly of a metal of the iron group and coarse by its particle size, the second constituent contains copper and/or phosphorus, and the third constituent contains mainly copper. For the material, a powder mixture is made which contains the largest amount of the third constituent and substantially less of both the first and the second constituents. The powder mixture is fed into a cavity preferably a mold-cavity and is sintered without compression of the powder mixture, without pressure, in this cavity and at a temperature which is above the melting point of the said second constituent.

8 Claims, 3 Drawing Sheets

MANUFACTURE OF DIMENSIONALLY PRECISE PIECES BY SINTERING

Figure 1:
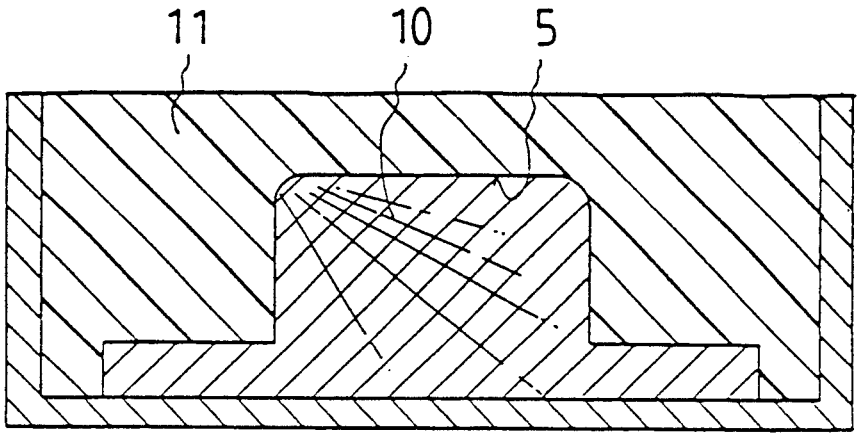

The invention relates to a method for the manufacture of dimensionally precise pieces which are at least in part made of a sintered material which, before the sintering, comprises a mixture of at least three pulverous constituents, of which the first is primarily of a metal of the iron group and with a maximum particle size of approx. 150 μm, the second constituent contains copper and/or phosphorus, with a maximum particle size of approx. 150 μm, and the third constituent contains at least copper. The invention relates in particular to the manufacture of forming tools by using at least in some phase the sintering method according to the invention The manufacture of forming tools has traditionally been both difficult and time-consuming, and therefore they have been relatively expensive. This is due to the fact that, when such tools are manufactured in large sizes, they must be made manually with high precision, in which case the manufacture as a rule starts with one steel piece into which the required cavities and holes are machined. This steel piece will then serve as both the frame and the mold surface against which the final product's metal part to be formed, such as a sheet, is formed by pressing.

It is also known to form sheet material by making a die from some material easier to form and thereafter to introduce, by means of a rubber diaphragm or the like, fluid pressure on one side of the metal sheet while the die is on the other side, and thus to press the sheet into the form of the die, as depicted in, for example U.S. Pat. No. 3,021,803. The advantage of this method is that in this case no prefabricated upper tool is needed for forming the sheet, since the pressure automatically adapts to the shape of the die. U.S. Pat. No. 3,996,019 discloses a further development of this method, by means of which different sheets and parts can to some extent be joined or laminated. These methods have the disadvantage that, when an easily machined material is used as the die, the production runs must be relatively short and the sheet to be worked on relatively thin, since such a die does not withstand the great force required for a thick sheet and since the die wears out and/or becomes damaged when the number of items is high.

It is known that relatively strong and complex pieces have been manufactured by molten-phase sintering, in which case different pulverous constituents are mixed, whereafter the mixture is fed into a mold and compacted either by vibrating and/or compressing before the mixture is heated so that one of the constituents melts and binds the other constituents together. In this case, through the capillary effect, the melt fills the spaces between the powder particles and, when solidifying, binds them together. The sintering itself can take place either under a very high pressure or under atmospheric pressure. This manufacturing method is not at all applicable to short production runs or to the manufacture of individual products, since the compression and/or vibrating of the powder requires strong and precise molds in order that the piece can be made so dense that it can withstand its removal from the mold and its sintering treatment as a detached piece. In addition, the pieces sintered tend to shrink during the sintering, which results in that the pieces need to be given a finishing treatment.

Mainly for the manufacture of magnetic pieces, in which what is desired is dimensionally precise products without the necessity of machining them after the sintering, powder mixtures have been developed by using which the shrinkage during sintering of a piece fed into a mold and compressed into a compact state in the mold can be diminished or eliminated. Such mixtures have been disclosed, for example, in publications SE-414 191, SE-372 293, EP-11 989 and JP-57-233041. Because of the magnetic properties, the objective in these magnetic mixtures is a relatively high phosphorus content, which increases the tendency of the material to shrink. It is noted in these publications that the adding of copper increases volume growth, i.e. it has an effect in a direction contrary to that phosphorus has. Thus these publications propose mixtures which, as a final product, contain iron more than 90%, the balance being copper, phosphorus and possibly carbon and other alloying elements. In addition, it is stated in these publications that the particle sizes of the various constituents of the powder mixture affect the shrinkage of the piece.

These prior-known methods have the disadvantage that it has not been possible by using them to manufacture sintered and dimensionally precise parts using a simple and easy-to-manufacture die, which requires the sintering of the piece in such a manner that it is not compressed, at least not to a considerable degree, and in such a manner that it is not necessary to carry out the sintering under a high pressure. When sintered without compression and under atmospheric pressure, the pieces have an especially great tendency to shrink during the sintering. Therefore it has not been previously at all possible to produce sintered pieces with shrinkages below 1%. Even this shrinkage is in a number of contexts so great that the method cannot be used. Consequently, pressureless and uncompacted sintering as a manufacturing method has rarely been used in the manufacture of freely formed parts, i.e. in the manufacture of parts which are not subjected to a subsequent finishing treatment, for example, for the manufacture of extruding tools needed in the extrusion of plastic parts. The non-use of the method is also due to the fact that the strength of pieces sintered in this manner is not of the same order as that of steel generally used, and in that case an extrusion die made of a sintered material will not alone withstand the pressures present in extrusion.

The object of the invention is thus to provide a method for producing sintered pieces which do not shrink or which shrink only slightly during sintering, in which case the sintered pieces have a very high dimensional precision. It is the object of the invention to provide this type of method which does not before sintering require compression of the powder used for the manufacture of the piece or a high pressure during sintering, in which case the mold for the feeding of the powder can be light in structure and simple. It is also an object of the invention to provide a method of this type, the products produced by which are additionally of such high strength that they are usable as such, for example, as extruding dies, deep-drawing tools, or other forming tools or the like. And it is a further object of the invention to provide a method of this type, by using which that surface portion of the sintered final product which is needed in a given case is of a predetermined material, and it is possible to arrange inside the final piece, as a structural part of it, components required by the operating devices.

By means of the method according to the invention, a crucial improvement is provided with respect to the disadvantages described above, and the objects mentioned above are achieved. In order to accomplish this, the method according to the invention is characterized in what is disclosed as characteristics in the claims of the present invention.

The most important advantage of the invention is that, by using a simple and inexpensive initial form, it is possible to form a mold cavity which is suitable for receiving a pulverous initial material, and that the material according to the invention does not shrink during sintering, in which case products of high precision of form and dimension can be produced, such as tool parts and the like, even if the production run is short. The shrinkage of products manufactured according to this invention is typically less than 0.1%, in which case, for example, the manufacture of tools can take place at a fraction of the costs which are traditionally incurred, owing to both the high dimensional precision and the simplicity of the mold, since compression and pressure are not required. The products made according to the invention are, however, sufficiently strong to be used as such as the said tools or the like.

The invention is described below in greater detail with reference to the accompanying drawings.

Figure 2:
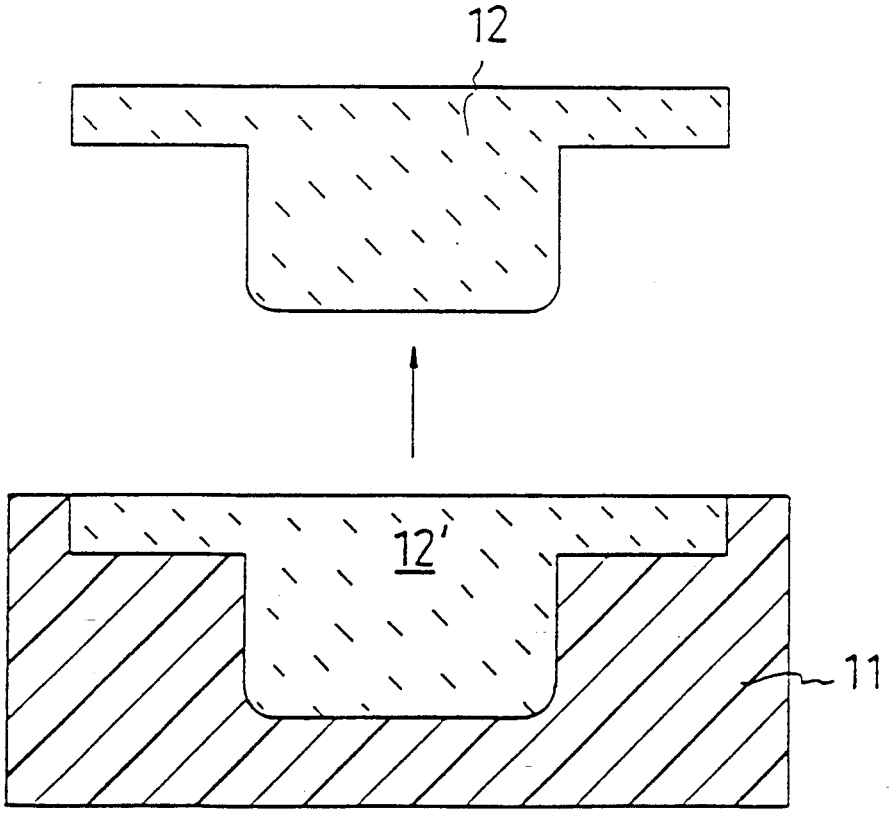
Figure 3:
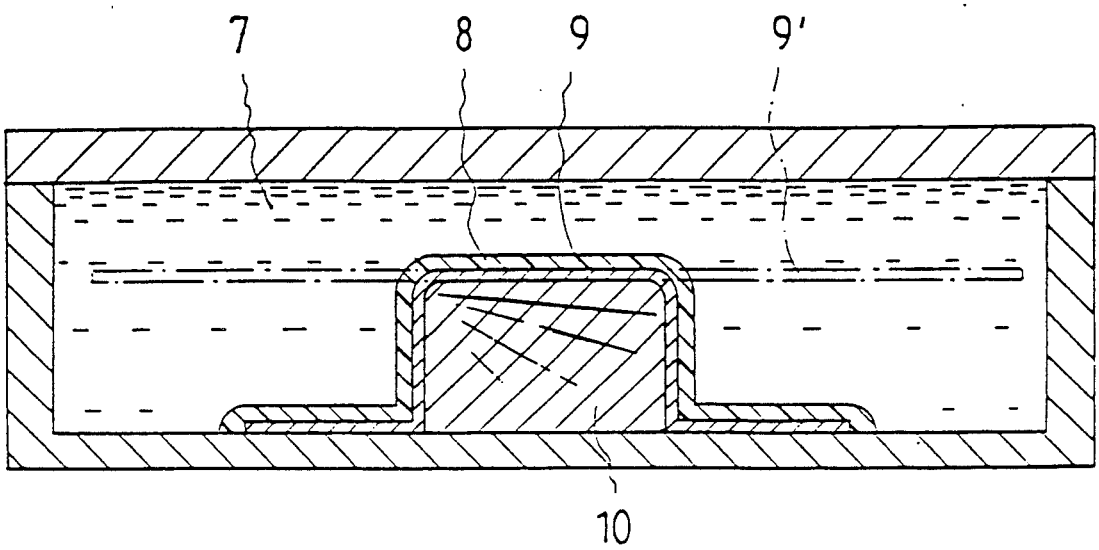
Figure 4:
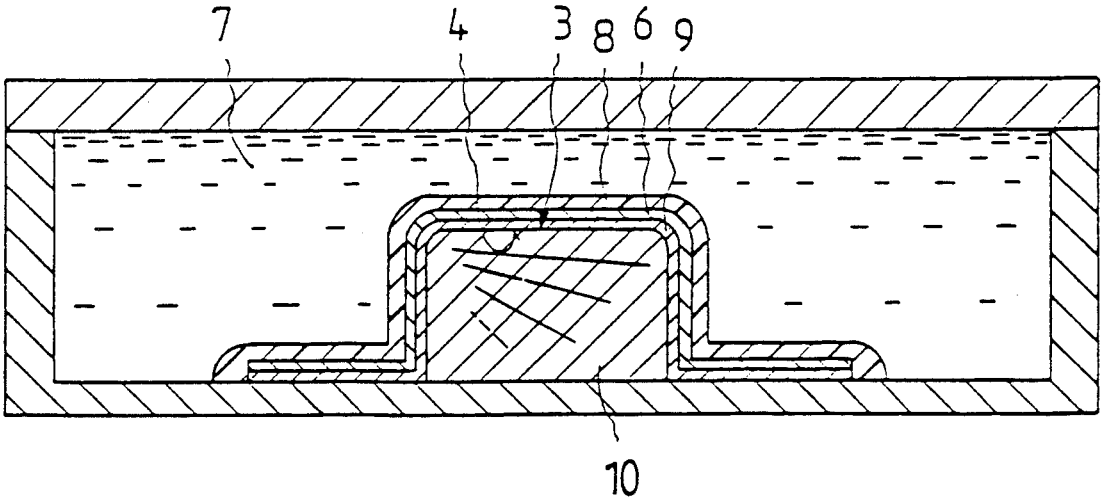
Figure 5:
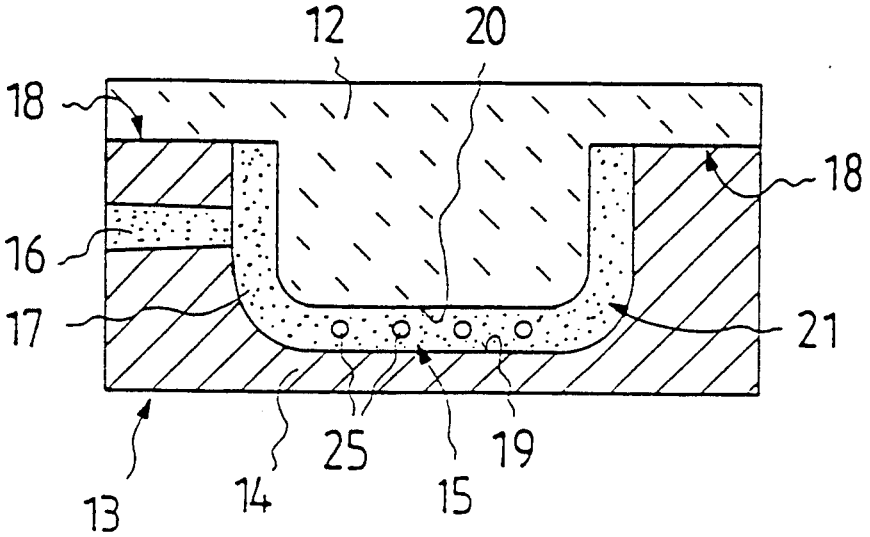
Figure 6:
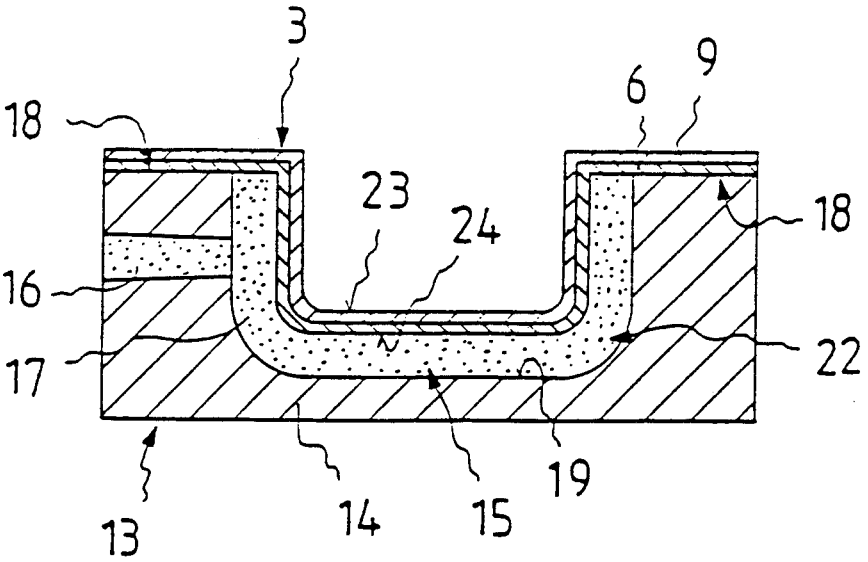

FIG. 1 depicts a method known per se for making a preliminary mold of a form, FIG. 2 depicts a principle known per se for making a piece by means of the preliminary mold, FIG. 3 depicts a method known per se for forming a sheet by means of a form, FIG. 4 depicts a further development, known per se, of the method depicted in FIG. 3, FIG. 5 depicts one embodiment of the method according to the invention for the making of a sintered piece, and FIG. 6 depicts another embodiment of the method according to the invention for the making of a sintered piece.

FIG. 1 shows a form 10 of the object to be manufactured using one half of the final tool or the tool. The form can be made of any suitable easily machined material, such as wood, plastic or the like. Over the form there is cast as a preliminary mold 11, for example silicon rubber, which is allowed to set. Thereafter the preliminary mold 11 is detached from the form 10, and thereafter a ceramic material 12' is cast into the cavity of the preliminary mold, which material is dried while it is in the preliminary mold 11. Thereafter the piece of solid ceramic mix is detached from the preliminary mold and is fired to produce a dense ceramic piece 12. In this manner the ceramic die 12 to be used in the method of the invention is obtained, the die corresponding very precisely to the original form 10 and retaining its dimensional precision also during heating, as is described below. The above-mentioned castable ceramic mix 12' can be of any suitable commercially available type and is not discussed here in greater detail.

FIG. 3 depicts another method applicable in connection with the invention for making a mold. In it a form 10 is used of the piece which is to be made with the final tool or its part. Here, also, the form 10 is made from some easily machinable material, such as wood, plastic, aluminum, zinc or the like. Over the form 10 there is usually placed a straight metal sheet 9', which in FIG. 3 is depicted with dashed lines, and over this a rubber diaphragm 8, and into the space 7 above this arrangement there is introduced, for example, fluid pressure, whereupon, by mediation of the rubber diaphragm 8, this pressure shapes the sheet according to the surface of the form 10. The metal sheet thus formed can be used in the method of the invention as a structural part of the sintering mold, as is described below. FIG. 4 depicts a further development of this sheet-forming method, in which the sheet 9 first formed is left over the form 10, the rubber diaphragm 8 is first removed and another sheet 6 is placed over the entity consisting of the form 10 and the sheet 9, and after the rubber diaphragm is returned to its place, this sheet 6 is pressed against the form and the sheet 9. Thereafter the combination 3 of the sheets 6 and 9 can be removed from over the form and can be used in the same way as the single sheet, in the manner described below. The sheets 9 and 6 may be of the same material or of different materials, or more than two sheet layers may be used. In this manner the structure can be given the desired strength and/or it can be given other desired properties.

Simultaneously a structural part according to the invention is made for the other half 13 of the tool by machining in a steel part 14, for example, a depression 15 the dimensions of which are somewhat greater than those of the first wall of the mold cavity, made in the manners described above. This depression 15 may be made coarsely, for example by grinding, without noteworthy dimensional requirements. The steel frame 14 is also provided with one or more channels 16 which extend from outside the frame 14 into the depression 15 and through which the powder mixture 17 to be sintered can be fed into the mold cavity.

Two ways according to the invention to form a mold cavity can be seen in FIGS. 5 and 6. In the embodiment according to FIG. 5, the mold part 12 of a ceramic material is placed on top of the steel frame 14. The steel frame 14 and the ceramic mold part 12 are so dimensioned in relation to each other that at their edges 18 they form a tight joint which will not let powder through. The surface 19 of the depression 15 ground into the metal frame 14 and the surface 20 of the ceramic piece 12, which surface corresponds to the effective surface 5 of the original form 10, form between them the mold cavity 21. In the embodiment of FIG. 6, one half 13 of the mold has been formed in principle in the same manner as above, in which case the ground depression 15 of the steel piece 14 forms with its surface 19 the opposite wall portion of the mold cavity 22. In this case the first wall portion 24 of the mold cavity consists of the sheet formed against the form 10, or in this case of the laminate 3 made up of the sheets 6, 9, and, in particular, of that side of it which has been away from the form 10. In other words, when FIG. 4 and FIG. 6 are compared, outer surface 24 of the sheet 6 constitutes the first wall portion of the mold cavity. That surface 23 of the second sheet 9 which has been against the original form 10 faces away from the mold cavity 22. Also, the edges of the sheet combination 3 are dimensioned so that their edge area 18 fits tightly against the corresponding areas in the frame piece 14.

Thereafter, a powder mixture 17 according to the invention is fed via the channels 16 by means of devices known per se into the mold cavity so that it is filled. Thereafter the material in the mold cavity 21 or respectively 22 is sintered at a suitable temperature, at which time the sintering material is simultaneously diffusion welded to the metal part of the mold cavity in the given case. In the case of FIG. 5 the material being sintered in cavity 21 is thus diffusion welded to wall 19 of the steel frame 14, thus forming a strong metallurgical joint, whereas the material being sintered is not able to wet the surface 20 of the ceramic mold part 12. As a result of this, when the sintering has been brought to completion and the piece has cooled, the ceramic part 12 can be removed, whereupon in the sintered part of the frame there is left an impression image of the surface 20, which is a dimensionally precise image of the surface 5 of the original form, and it can thus be used for manufacturing, with dimensional precision, products according to the original form.

In the embodiment of FIG. 6, the material being sintered in cavity 22 is diffusion sintered both to the surface 19 of the metal frame and to the metal surface 24 of the other mold half, in which case nothing can be detached from the piece formed. However, since the surface 23 was, however, a dimensionally precise impression or image of the original form surface 4, it is possible by this produced tool to manufacture, with dimensional precision, products according to the original form.

To direct the progress of the sintering in such a manner that the targeted dimensional precision is achieved, the powder mixture according to the invention is used, which has constituents which have an expanding effect, thus compensating for the tendency of a conventional powder mixture to shrink. The expanding portion of the powder is made up of at least two different powder constituents, the first of them being primarily of a metal of the iron group, preferably mainly nickel, and the second constituent containing copper and phosphorus. According to the invention, the third constituent is a copper-based alloy and it constitutes in the powder mixture the primary constituent, which produces, when necessary, the fine surface of the final product and most of its strength, but if it were used alone it would shrink drastically during sintering. On the other hand, the nickel-copper-phosphorus mixture swells during the sintering, whereby the shrinkage is compensated for. Each of the constituents must be soluble in the others. The melting point of the metal of the first constituent must be considerably higher than the melting points of the other constituents. The particle sizes are selected so that the first constituent is made up only of relatively large particles, i.e. any smaller particles have been separated out. The particle size of the second constituent is smaller, but its particle size does not have a substantial significance in terms of the result. Thus the first powder constituent is made up of, for example, nickel, the extreme values of its particle size distribution being between approx. 10 and 200 μm, it being advantageous to use a powder having an average particle size within the range of approx. 100–150 μm, for example 100 μm, in which case the powder does not contain particles smaller than approx. 50 μm and not larger than approx. 150 μm. The second powder constituent comprises, for example, a copper-phosphorus compound $Cu_3P$, in which case it is advantageous that the average particle size of this constituent is less than 50 μm. The third constituent is preferably bronze or brass, the alloy analysis of which may be conventional or correspond to standards, i.e. of a suitable commercially available type. The average particle size of the third constituent may vary within the range of approx. 5–200 μm, depending, for example on the surface quality requirements. The amounts and ratios of nickel and $Cu_3P$, as well as their particle sizes, are to be adapted to the third constituent, since the dimensional change depends among other things on the particle size of this constituent.

It has been observed to be advantageous to combine the above- mentioned constituents in such a manner that the third, principal, constituent is used at approx. 60–75% by weight and the first constituent at approx. 20–30% by weight, and the second constituent at approx. 5–10% by weight, in order to produce a non-shrinking mixture. After being fed into the mold cavity the mixture is sintered at a temperature of at minimum 800° C. and preferably at a temperature of approx. 850° C.

The non-shrinking material according to the invention, described above, is based on a combination of the following features. In general, applications of powder metallurgy aim at accomplishing products as dense and compact as possible. The production of fully dense products is difficult, since the question is of filling all of the pores in the pieces. This leads to the situation that the material in the piece must travel inward from the outside, and as a consequence the piece shrinks. If an absolute denseness is required, this always means reduction of the pre-sintering volume, i.e. shrinkage. In tool manufacture, to which this patent application relates, dimensional precision is, however, the most important requirement, and any other properties are to be adapted and optimized accordingly. Thus the invention utilizes a normally shrinking constituent (bronze, brass, or the like) and an expanding alloying constituent.

The action of the expanding alloying constituent of the invention can, as a phenomenon, be explained as follows: When a material is sintered in the solid state, an individual powder material shrinks practically always. The linear shrinkage varies between 1 and 15%, depending on the process. This shrinkage can be reduced or eliminated by adding to this principal constituent a pulverous constituent or mixture the volume of which increases under the sintering conditions. Such expanding powder combinations comprise at least two constituents, which are soluble in each other. When the sintering temperature is such that one of the powder constituents melts, these two constituents dissolve in each other. However, smaller particles have a higher energy content and thus a greater tendency to form solutions. When rather large particles are used as the non-melting constituent, atoms from the molten phase are diffused considerably more rapidly into the solid phase than from the solid phase into the melt. As a consequence of this, the volume of the larger particles increases as the smaller ones dissolve, in which case their disappearance from the intermediate spaces between large particles has no substantial significance for the volume of the piece.

In the manufacture of tools, and particularly plastic tools, it is possible, before the assembling of the mold and the feeding in of the powder, to place tubes 25 in the mold cavity in order to cool the product at its final point of use, electric resistors to heat the final product in its final use, or other elements, which thus remain inside the final sintered piece, constituting a structural part of it, since they are diffusion welded to or mechanically locked (if the parts are ceramic) in the material sintered.

By a suitable combination of the above-mentioned materials, numbers of particle sizes, and sintering temperatures it is possible to produce pieces in which no or very little shrinkage takes place during sintering and which, when so desired, may also expand. This is due to the fact that the volume increase caused by constituents one and two together compensates for the shrinkage of a third, the principal, constituent. Thus, such conditions are created at the sintering temperature that the second constituent is molten and the first constituent is solid, in which case the second constituent has a greater solubility in the first constituent than the first constituent has in the second constituent, and the third constituent is in the solid state. In this case, the atoms diffusing from the second constituent into the first constituent expand the volume of the latter, which compensates for the diffusion of atoms of the third constituent from the outside inward into the spaces between particles.

When, in accordance with the invention, a frame of steel or some other alloy and a metallic or ceramic counter-mold is used, it is possible to manufacture tools or other pieces with a surface of precise dimensions and with excellent strength and density, as the sintering material becomes welded to the metallic structural part. The non-shrinking material according to the invention can, of course be used according to the invention also without a metallic frame, for example in a mold cavity between two ceramic mold halves, in which case the final product is of sintered material only.

We claim:

1. A method for the manufacture of dimensionally precise pieces which at least in part are made up of a sintered material which, before the sintering, comprises a mixture of at least three pulverous constituents, of which the first is mainly of a metal of the iron group, having a particle size of at maximum approximately 150 μm, the second constituent contains copper and/or phosphorus and has a particle size of at maximum approximately 150 μm, and the third constituent is a copper based alloy, wherein the powder mixture contains the largest quantity of the third constituent and substantially less of both the first and the second constituent, that the powder mixture is fed into a moldcavity formed between at least two walls (19 and 24; 19 and 20) of the cavity structure, and is sintered without compression of the powder mixture, without pressure, in this cavity and at a temperature which is above the melting point of the said second constituent.

2. A method according to claim 1, wherein the said third constituent is mainly bronze and/or brass, the second constituent is mainly a $Cu_3P$ compound and the first constituent is mainly nickel, that the minimum size of the particles of the first constituent is approximately 50 um and their average size approximately 100 um, and the particle size of the second constituent is considerably smaller, and that the sintering takes place at a temperature above approximately 800° C.

3. A method according to claim 1, wherein the third constituent at approximately 60–75% by weight, the second constituent at approximately 5–10% by weight, and the first constituent at approximately 20–30% by weight are mixed to produce the said material.

4. A method according to claim 1, wherein the first wall (20; 24) of the cavity (21; 22) is of metal or a ceramic material and its second wall (19) is of metal, in which case the material being sintered during the sintering is simultaneously diffusion welded to the metallic wall portion of the mold but not to the ceramic wall portion, which is thus detachable from the piece and from the rest of the structure after the sintering.

5. A method according to claim 4, wherein the metallic second wall portion (19) is a surface coarsely machined into the metal part (14), and that the ceramic first wall portion (20) is, made from a ceramic mix (12) by casting it, by drying and firing it with the help of a preliminary mold (11) taken of the original form (10), in which case the ceramic first wall portion produces the formed usable surface of the final piece and the said metal part constitutes the frame of the final piece.

6. A method according to claim 4, wherein the metallic first wall portion (24) is one side of a part (3 or 9) formed from a metal sheet by means of fluid pressure against a form (10) and that the metallic second wall portion (19) is a surface coarsely machined into the metallic part (14), in which case the said material becomes diffusion welded to both wall portions (19, 24), and the other sheet side (23) constitutes the formed usable surface of the final piece and the metal part constitutes the frame of the final piece.

7. A method according to any of claims 4–6, wherein before the feeding in of the powder material, there are placed in the cavity (21; 22) tubes, electric resistors or other tool components (25) which thus remain inside the final sintered piece.

8. A method according to any of claims 4–6, wherein the metal part (14) is of a metal or a metal alloy and the metal sheet (9) is of a metal or a metal alloy and/or a metal sheet laminate (3) which has been formed by forming, by means of fluid pressure, several sheets one after the other over a die.

* * * * *